US010782004B2

(12) United States Patent
Stout

(10) Patent No.: US 10,782,004 B2
(45) Date of Patent: Sep. 22, 2020

(54) SYSTEMS AND METHODS FOR A LADDER WITH INTEGRATED LIGHTS

(71) Applicant: STOUT INDUSTRIES, INC., Hutto, TX (US)

(72) Inventor: Ryan Stout, Hutto, TX (US)

( * ) Notice: Subject to any disclaimer, the term of this patent is extended or adjusted under 35 U.S.C. 154(b) by 0 days.

(21) Appl. No.: 16/291,464

(22) Filed: Mar. 4, 2019

(65) Prior Publication Data

US 2019/0195472 A1 Jun. 27, 2019

Related U.S. Application Data

(63) Continuation of application No. 15/071,151, filed on Mar. 15, 2016, now Pat. No. 10,260,717.

(60) Provisional application No. 62/134,116, filed on Mar. 17, 2015.

(51) Int. Cl.

| | |
|---|---|
| ***F21V 33/00*** | (2006.01) |
| ***F21V 21/00*** | (2006.01) |
| ***E06C 7/00*** | (2006.01) |
| *F21S 9/02* | (2006.01) |
| *F21Y 115/10* | (2016.01) |

(52) U.S. Cl.

CPC ..... *F21V 21/00* (2013.01); *E06C 7/003* (2013.01); *F21V 33/0064* (2013.01); *F21S 9/02* (2013.01); *F21Y 2115/10* (2016.08)

(58) Field of Classification Search

CPC .. F21V 21/00; F21V 33/0064; F21Y 2115/10; F21S 9/02; E06C 7/003; E06C 5/34

See application file for complete search history.

(56) References Cited

U.S. PATENT DOCUMENTS

| | | | | |
|---|---|---|---|---|
| 2009/0166128 | A1* | 7/2009 | Kuhlman | E06C 7/003 182/129 |
| 2010/0142215 | A1* | 6/2010 | Waring | B60Q 1/2657 362/249.02 |
| 2015/0308628 | A1* | 10/2015 | Athalye | F21K 9/232 362/650 |
| 2016/0238232 | A1* | 8/2016 | Eubanks | F21V 29/83 |

* cited by examiner

*Primary Examiner* — Y M. Quach Lee
(74) *Attorney, Agent, or Firm* — Pierson IP, PLLC

(57) ABSTRACT

Embodiments disclosed herein describe systems and methods for a lighting device that is configured to couple with the end of a ladder. The lighting device may be configured to illuminate a room within a building with different types of light being projected in different, predetermined directions. Therefore, a firefighter within the building may be able to determine the location of the ladder even if heavy smoke is positioned within the building. Accordingly, the firefighter may be able to enter the building quicker because the firefighter may not have to bring an extra light, while also allowing the firefighter to exit the building quicker.

11 Claims, 6 Drawing Sheets

SYSTEMS AND METHODS FOR A LADDER WITH INTEGRATED LIGHTS

CROSS-REFERENCE TO RELATED APPLICATIONS

This application claims a benefit of priority under 35 U.S.C. § 119 to U.S. Provisional Patent Application No. 62/134,116 filed Mar. 17, 2015, which is hereby fully incorporated herein by reference in its entirety.

BACKGROUND INFORMATION

Field of the Disclosure

Examples of the present disclosure are related to systems and methods for a ladder with integrated lights. More particularly, embodiments relate to a lighting device that is configured to couple with an end of the ladder, wherein the lighting device emits different types of lights in different directions.

Background

Conventionally a ladder is a vertical or inclined set of rungs or steps. Firemen typically use extension or telescopic ladders that are divided into two or more lengths for more convenient storage. The lengths can be slid together for storage or slid apart to expend the length of the ladder.

During a response event, to access an elevated floor in a multistory building, a first responder will position the ladder against one of the windows in the building or roof. Responsive to breaking the window, the first responder can access the elevated floor. Once inside the building, the first responder may assist in putting out the fire and/or saving victims in various rooms within the building.

However, during a fire, smoke is emitted within the building. This smoke limits the fire fighter's view of the ladder and the rooms within the building. Due to the smoke, when the first responder is assisting putting out the fire and/or saving victims in various rooms on the floor, the first responder may not be able to locate the location of the ladder.

Accordingly, needs exist for more effective and efficient systems and methods for a lighting device that is configured to couple with an end of the ladder, wherein the lighting device emits different types of lights in different directions.

SUMMARY

Embodiments disclosed herein describe systems and methods for a lighting device that is configured to couple with the end of a ladder. The lighting device may be configured to illuminate a room within a building, a roof top, or any other opening associated with a structure (referred to hereinafter collectively and individually as "building"). The lighting device may be configured to emit different types of light, wherein the different types of lights may be projected in different, predetermined directions. Therefore, a firefighter within the building may be able to determine the location of the ladder and objects within the room, even if heavy smoke is positioned within the building. Additionally, the firefighter may be able to enter the building quicker because the firefighter may not have to bring an extra light or tool to break a window. The light within the building may also allow the firefighter to quickly locate the ladder to exit the building quicker.

In embodiments, the lighting device may be configured to couple with an end of the ladder. The lighting device may include projections that are configured to slide into a hollowed out chamber or slots within the rails of the ladder. Responsive to sliding the projections into the ladder, a base surface of the lighting device may be positioned adjacent to the end of the ladder and the outer surface of the rails may be flush with the sides of the lighting device. In other embodiments, the lighting device may include a stump, coupling mechanism, etc. that spans the width of the projections. The coupling mechanism may be configured to be inserted within the chamber of the ladder to couple the lighting device to the ladder.

In embodiments, the lighting device may include an internal compartment, lighting channel, and an external blade.

The internal compartment may be configured to house a battery and processor for the lighting device. The internal compartment may be a separate chamber than the lighting channel, wherein the internal compartment may be centrally located within the lighting device.

The lighting channel may be positioned on an external, outer circumference of the lighting device, wherein different types of lights may be positioned within the lighting channel. For example, a first type of light may be positioned proximate to a first end of the lighting channel, and a second type of light may be positioned from the first type of light to a second end of the lighting channel.

In embodiments, the first type of light may be configured to illuminate the floor or a departure area. The second type of light may be configured to illuminate the building, the area above the ladder, and the area behind the ladder. Utilizing the different types of lights, firefighters within the building may be able to quickly determine the location of the ladder, while also illuminating the area within the building. Additionally, utilizing the lights, others positioned outside of the building may also be able to quickly determine the location of the ladder.

In embodiments, the external blade may be a metal blade or cutting surface that is configured to extend away from the circumference of the lighting device, and extend on a face of the lighting device from the first end of the lighting device to the second end of the lighting device. Responsive to positioning the lighting device against a window, the external blade may be configured to shatter, break, etc. the window. The external blade may be configured to extend across the circumference of the ladder such that the blade may shatter the window regardless of the orientation of the ladder.

These, and other, aspects of the invention will be better appreciated and understood when considered in conjunction with the following description and the accompanying drawings. The following description, while indicating various embodiments of the invention and numerous specific details thereof, is given by way of illustration and not of limitation. Many substitutions, modifications, additions or rearrangements may be made within the scope of the invention, and the invention includes all such substitutions, modifications, additions or rearrangements.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

Figure 1:
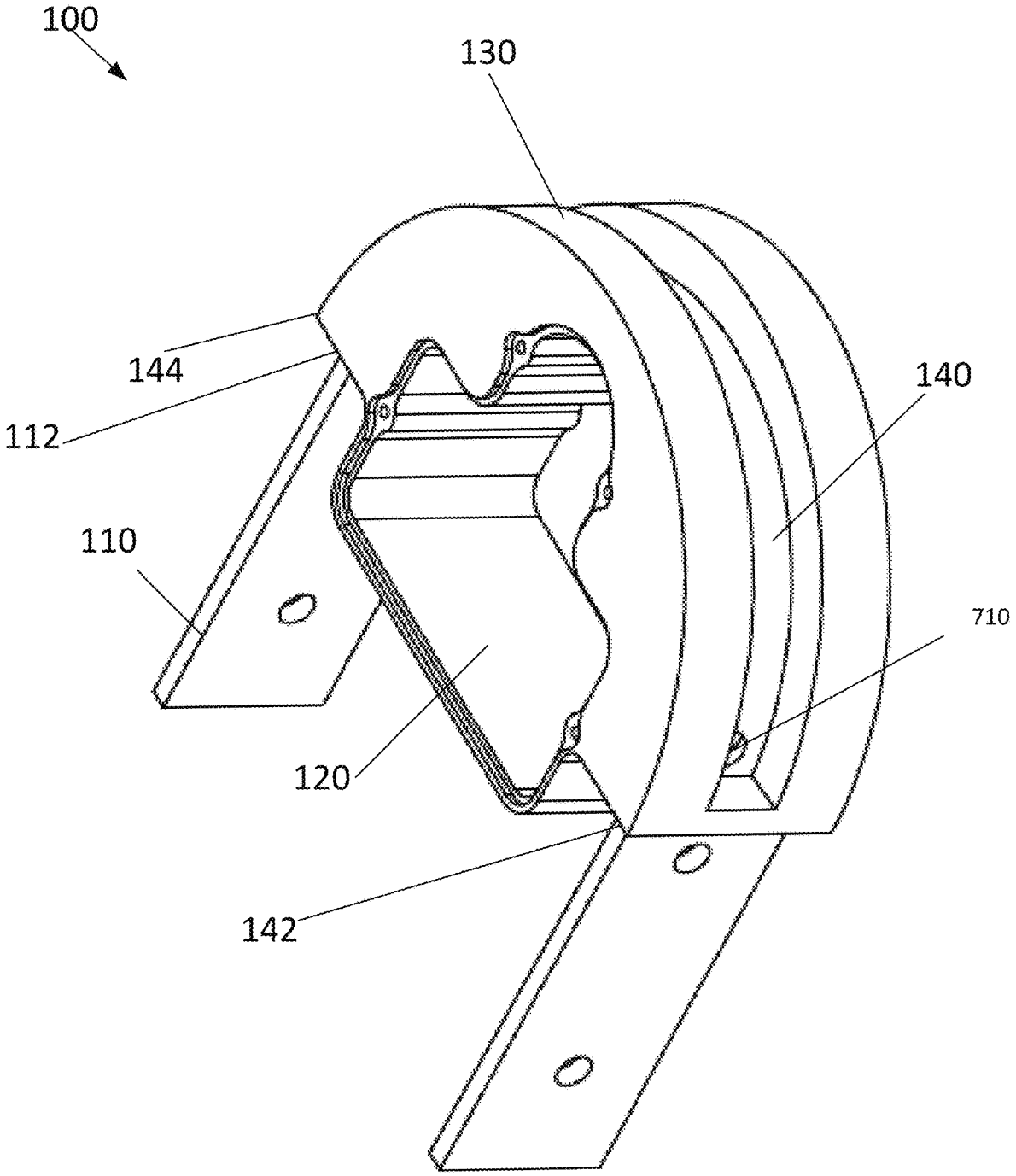
FIG. 1 depicts a lighting device, according to an embodiment.

Corresponding reference characters indicate corresponding components throughout the several views of the drawings. Skilled artisans will appreciate that elements in the figures are illustrated for simplicity and clarity and have not necessarily been drawn to scale. For example, the dimensions of some of the elements in the figures may be exaggerated relative to other elements to help to improve understanding of various embodiments of the present disclosure. Also, common but well-understood elements that are useful or necessary in a commercially feasible embodiment are often not depicted in order to facilitate a less obstructed view of these various embodiments of the present disclosure.

DETAILED DESCRIPTION

In the following description, numerous specific details are set forth in order to provide a thorough understanding of the present embodiments. It will be apparent, however, to one having ordinary skill in the art that the specific detail need not be employed to practice the present embodiments. In other instances, well-known materials or methods have not been described in detail in order to avoid obscuring the present embodiments.

Embodiments disclosed herein describe systems and methods for a lighting device that is configured to be integrated with a rail of a ladder. The lighting device may be configured to illuminate a room within a building with different types of lights, wherein the lights are positioned in different, predetermined locations. Therefore, a firefighter within the building may be able to determine the location of the ladder even if heavy smoke is positioned within the building.

Turning now to FIG. 1, FIG. 1 depicts one embodiment of a lighting device 100, wherein lighting device 100 is configured to couple with an end of a rail of a ladder. Lighting device 100 may include projections 110, overhang 112, internal compartment 120, external circumference 130, and lighting channel 140.

Projections 110 may be projections, outcrops, protrusions, etc. that extend away from a body of lighting device 100. A first projection 110 may be configured to be positioned proximate to a first end 142 of lighting device 110, and a second projection 110 may be configured to be positioned proximate to a second end 144 of lighting device 100. The first projection 110 and the second projection 110 may be spaced at a distance that corresponds with the internal width of a ladder. In embodiments, a single projection 110 may be used, wherein the single projection includes a unifying plate, face, etc. between the first and second outcrops. Projections 110 may be configured to slide into a hollow rail of the ladder or slots within the ladder configured to receive projections 110. Responsive to sliding projections 110 into the ladder, projections 110 may be positioned adjacent to the inner sidewalls of the ladder.

Overhangs 112 may be an outcrop, protrusion, etc. that is configured to extend perpendicularly away from the ends of projections 110. Overhangs 112 may have substantially the same width as the thickness of the rail of the ladder. Responsive to sliding projections 110 into the rail of the ladder, overhangs 112 may be configured to be positioned adjacent to the end of the ladder. Furthermore, because overhangs 112 have substantially the same width as the thickness of the rail of the ladder, when overhangs 112 are positioned adjacent to the ends of the ladder, the outer sides of rail may be positioned flush with the ends of overhangs 112.

Internal compartment 120 may be a housing configured to store the processor and battery associated with lighting device 100. Internal compartment 120 may be a separate housing from lighting channel 140, which stores the light emitters. In embodiments, internal compartment 120 may be accessed via an orifice on a first sidewall of lighting device 110. Furthermore, internal compartment 120 may extend into the body of the rail of the ladder when lighting device 100 is coupled with the ladder. Therefore, when internal compartment 120 is positioned within a ladder, the lowest surface of internal compartment may be vertically below a top surface of the ladder and overhangs 112. Internal compartment 120 may extend into the body of the rail to increase the storage space of internal compartment 120, and to provide further protection from the components stored within internal compartment 120.

More specifically, a first portion of internal compartment 120 may be configured to be positioned within the rail of a ladder when lighting device 100 is coupled with the ladder, and a second portion of internal compartment 120 may be positioned outside of the rail of the ladder when lighting device 100 is coupled with the ladder. In embodiments, components that are less susceptible to environmental hazards may be positioned within the second portion of internal compartment 120, and components that are more susceptible to environmental hazards may be positioned within the first portion of internal compartment 120.

External circumference 130 may be form a boundary, perimeter, or border for lighting device 100 when lighting device 100 is inserting into a rail of ladder. External circumference 130 may form a rounded, semi-circle that extends from first end 142 of lighting device 100 to second end 144 of lighting device 100. In embodiments, external circumference 130 may have an apex at the middle of external circumference.

Lighting channel 140 may be a channel, groove, depression, etc. positioned on external circumference 130, wherein lighting channel 140 may be centrally located across external circumference 130. Additionally, lighting channel 140 may have a uniform width and depth that extends from a point proximate to first end 142 of lighting device 100 to a point proximate to second end 144 of lighting device 100. Lighting channel 140 may be configured to house and store lights for lighting device 100. Lighting channel 140 may also include a protective shield that is configured to slide over lighting channel 140 to protect the lights positioned within lighting channel 140. Lighting channel 140 may not be extend to first end 142 or second end 144 of lighting device 100 to protect the lights positioned within lighting channel 144, and also so lights positioned at first end 142 or second end 144 protect away from lighting device 100 at an angle that is tangential to a ladder.

In embodiments, different types of lights may be positioned within lighting channel 140. For example, a first type of light may be positioned proximate to first end 142 of lighting channel 140, and a second type of light may be positioned from the first type of light to second end 144 of lighting channel 140. The first type of light may be configured to illuminate the floor or a departure area. The second type of light may be configured to illuminate the building, the area above the ladder, and the area behind the ladder. Utilizing the different types of lights, firefighters within the building may be able to quickly determine the location of the ladder via the first type of lights, while the second type of lights illuminates the area within the building. Additionally, utilizing the lights, others positioned outside of the building may also be able to quickly determine the location of the ladder. The first type of light may be configured to emit a type of light that is beneficial where a region of interest may be closer to lighting channel 140, whereas the second type of light may be configured to emit a type of light that is beneficial where a region of interest is more distal to lighting channel 140. For example, it may be desirable for a first type of light to be shown on a floor surface of a building, whereas it may also be desirable for a second type of light to be emitted into a room.

More specifically, lighting device 100 may include different types of lights, wherein the different types of lights may emit different types and/or colors of lights.

The first type of light 710 may be a light emitting diode (LED) positioned within lighting channel 140, at a position that is proximate to first end 142. The first type of light 710 may be positioned proximate to the first end 142 of lighting device 100 so that when light device 100 is positioned within a window, light 710 may emit light on a floor surface directly below lighting device 100. In embodiments, the first type of light 710 may be configured to emit light in the visible light spectrum. The first type of light 710 may be configured to emit visible light. Accordingly, when a firefighter is within a building, the firefighter may be able to quickly determine the location of the ladder. In embodiments, the first type of light 710 may be a departure illuminator. When the departure illuminator is positioned within a window, the departure illuminator may be configured to illuminate the floor of a room accessed via the window. The departure illuminator may point directly below the end of the ladder to a distant wall. Therefore, the departure illuminator may assist firefighters in seeing around the room under thick smoke. Additionally, the departure illuminator may assist firefighters in finding the ladder once inside the room.

The second type of light may be LEDs configured to emit visible light and infrared light. The second type of lights may be positioned at even intervals within light channel 140 at a position proximate to first type of light 710 to a position proximate second end 144 of light channel 140. The second type of lights may be configured to blink at a predetermined and/or repetitive pattern, wherein the second type of lights may emit light in front, above, and behind lighting device 100. In embodiments, the second type of lights may be configured to emit infrared light having a longer wavelength than those of visible light, such that a drone flying above the second type of lights may be able to determine the location of the ladder. Additionally, the second type of lights may be configured to emit light with a longer wavelength than the first type of light 710 so that the second type of lights may illuminate an entire room within a building. Whereas, the first type of light 710 may be a spot light that is configured to clearly illuminate a single area. In embodiments, the second type of lights may be beacon lights. The beacon lights may be utilized by command to have a visual reference of the placement of all ladders on the fire ground for more accurate operational control. When the beacon lights are placed on a roof of a building, the beacon lights allow firefighters to know where the ladder is located in the event of a roof collapse. When the beacon lights are placed within a window, the beacon lights may illuminate smoke in the corresponding room, such that firefighters operating inside the building have a reference of what room the ladders is located in for quicker rescue and extraction.

In embodiments, a second sidewall of lighting device 100 may be comprised of a unitary piece. The second sidewall may utilize the unitary piece to protect the components housed within internal compartment. However, the second sidewall may have the same shape as the first sidewall.

Figure 2:
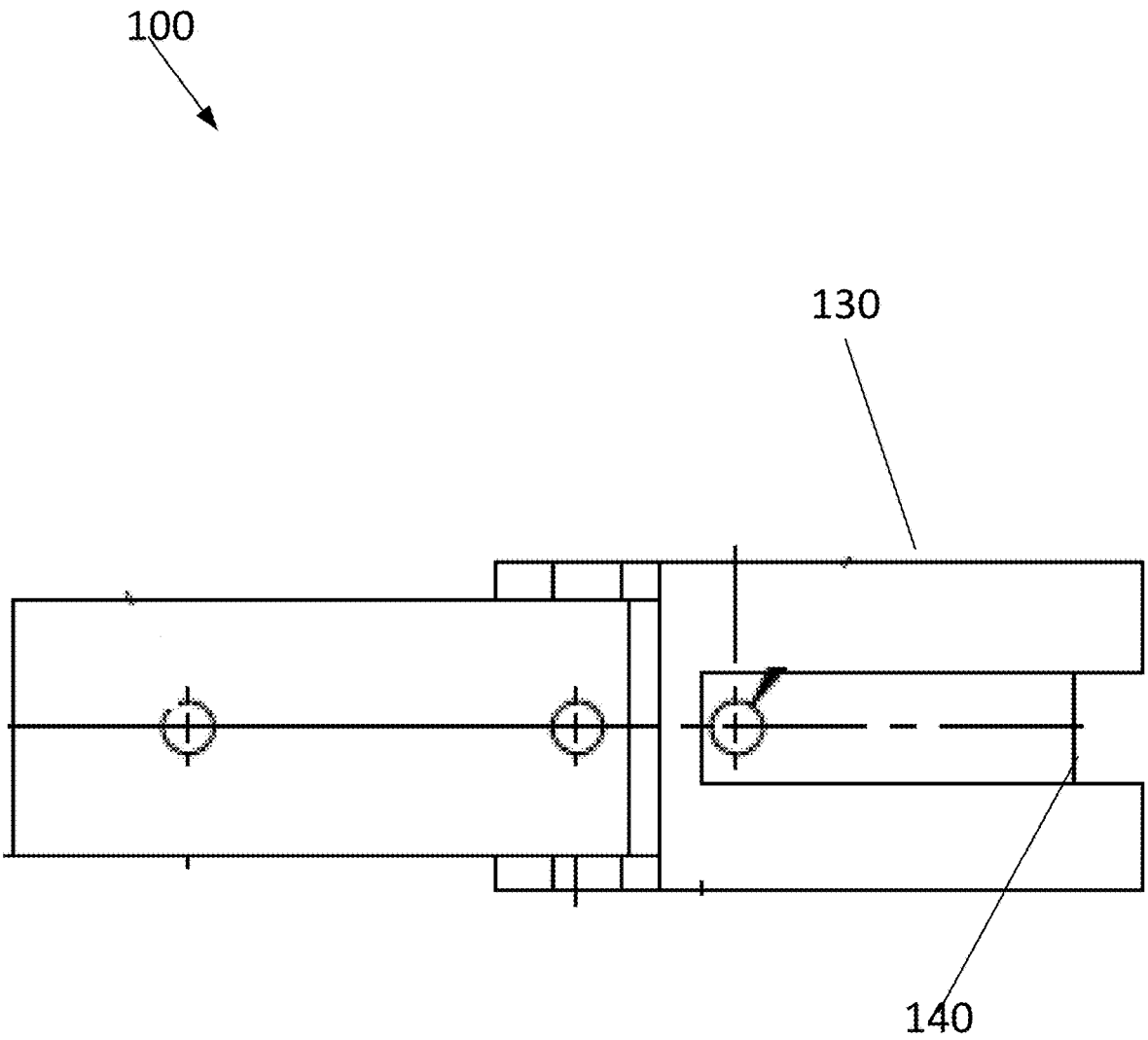
FIG. 2 depicts a top view of a lighting device, according to an embodiment.

FIG. 2 depicts one embodiment of a top view of lighting device 100. As depicted in FIG. 2, lighting channel 140 may be a depression, groove, etc. positioned along the external circumference 130, wherein lighting channel 140 may have the same arc as external circumference 130. Additionally, lighting channel 140 may extend from the first end of lighting device 100 to the second end of lighting device 100 forming uniform channel. Lights may be disposed throughout lighting device 100 such that light emitted from lighting channel 140 may emit light in a plurality of directions, which may extend around a full semi-circle.

Figure 3:
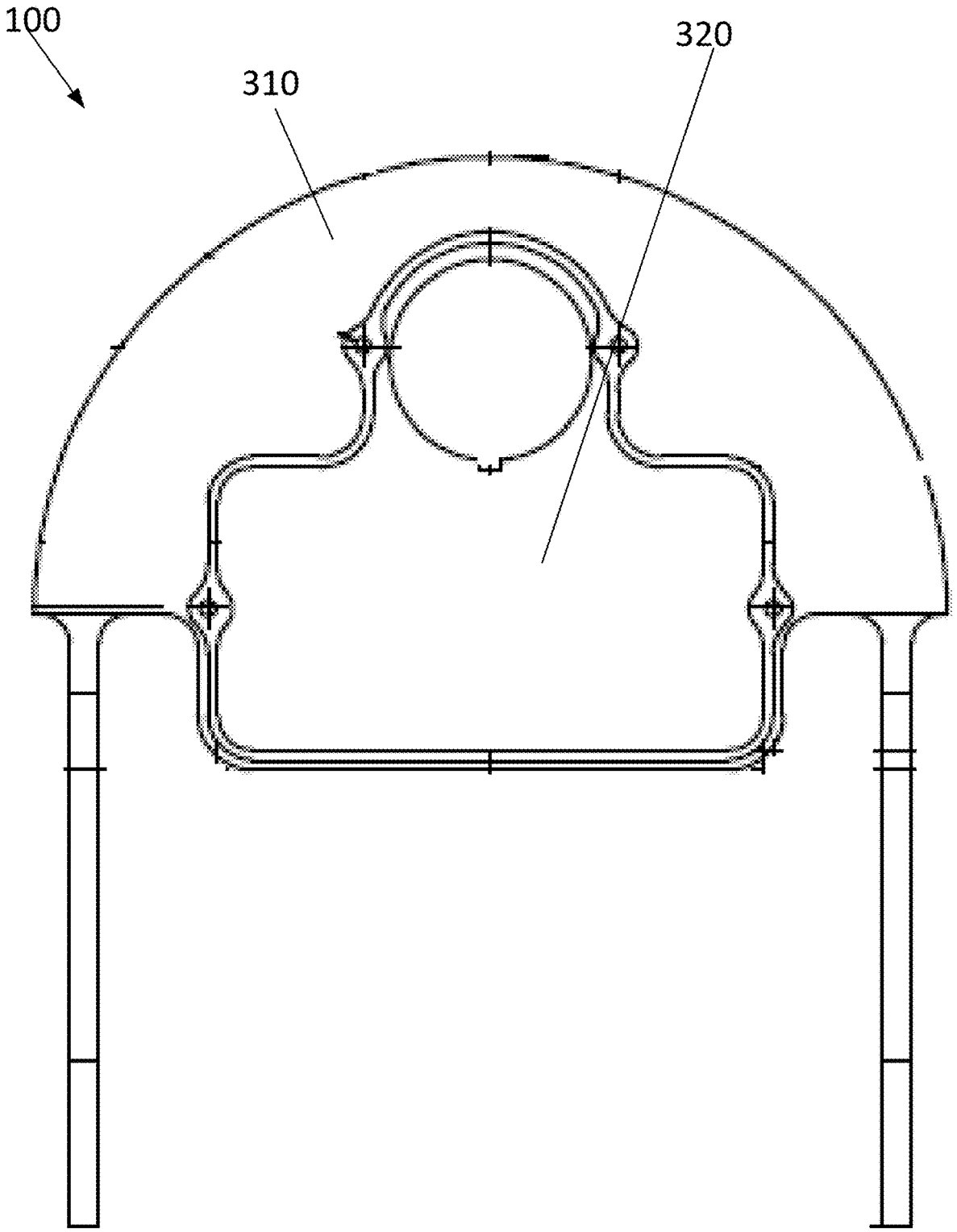
FIG. 3 depicts a side view of lighting device, according to an embodiment.

FIG. 3 depicts one embodiment of a side view of lighting device 100. As depicted in FIG. 3, a first sidewall 310 of lighting device 100 may include a cover 320. Cover 320 may be configured to cover internal compartment 120. Cover 320 may be a removable compartment that is substantially the same shape of internal compartment 120. In embodiments, if the components housed within internal compartment 120 need repairing or replacing, then cover 320 may be removed from internal compartment 120.

Figure 4:
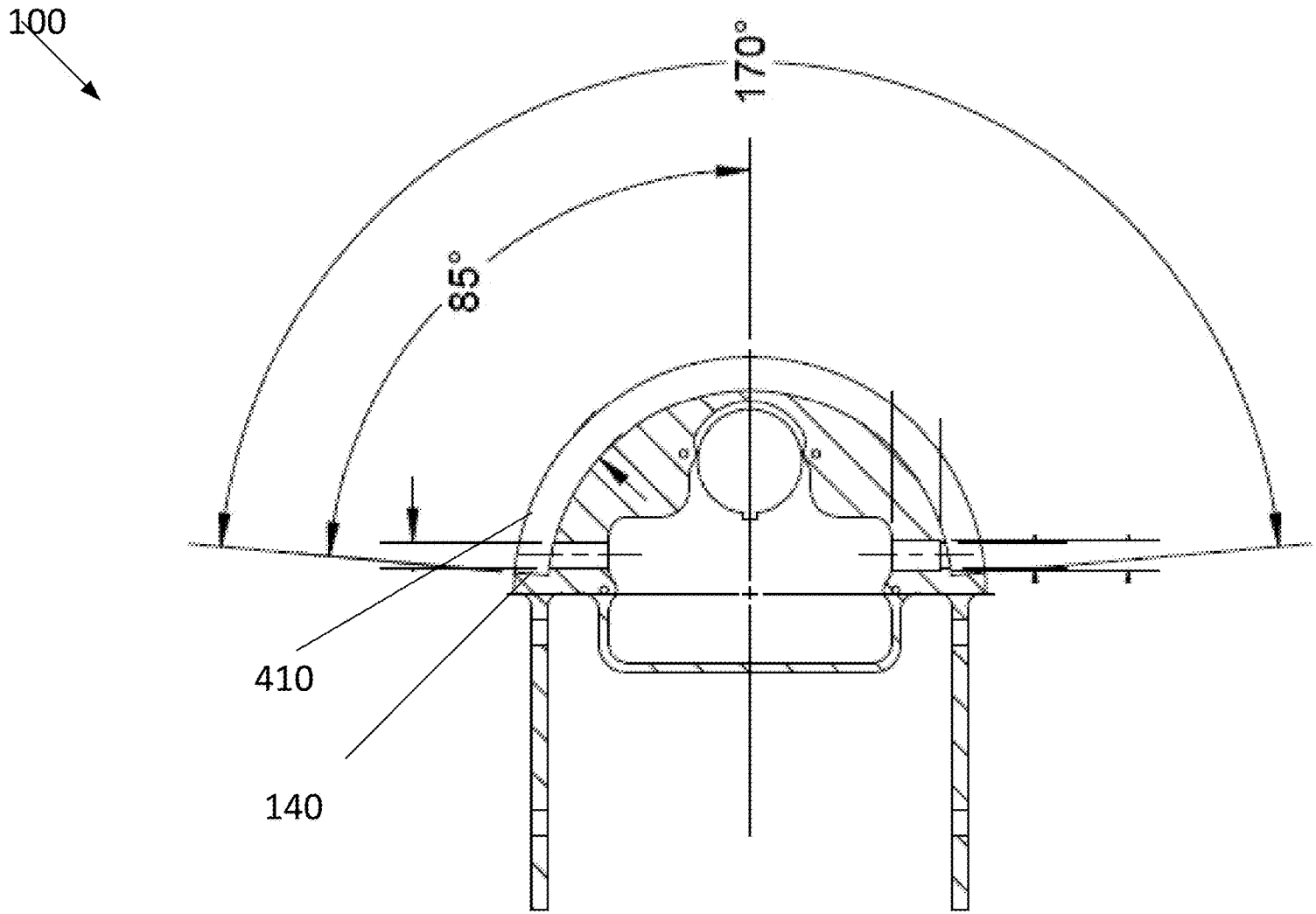
FIG. 4 depicts a lighting device, according to an embodiment.

FIG. 4 depicts schematics of lighting device 100, according to an embodiment. Elements represented in FIG. 4 may be substantially the same as other previously described embodiments. Therefore, for the sake of brevity an additional description of these elements is omitted.

As depicted in FIG. 4, lighting channel 140 may extend one hundred-seventy degrees around external circumference. Accordingly, when lighting device 100 is positioned within a window, first end 142 of lighting device may be angled at a downward angle, which may be utilized to illuminate a surface directly below and in-front of lighting device 100.

Furthermore, channel 140 may be recessed from an outer circumference 410 of lighting device 100. Lights positioned within the recession may have emitted light that is able to be emitted within the channel, and refracted or reflected off the sidewalls of the channel 140, which may allow for greater light dispersion or focus over an area of interest.

Figure 5:
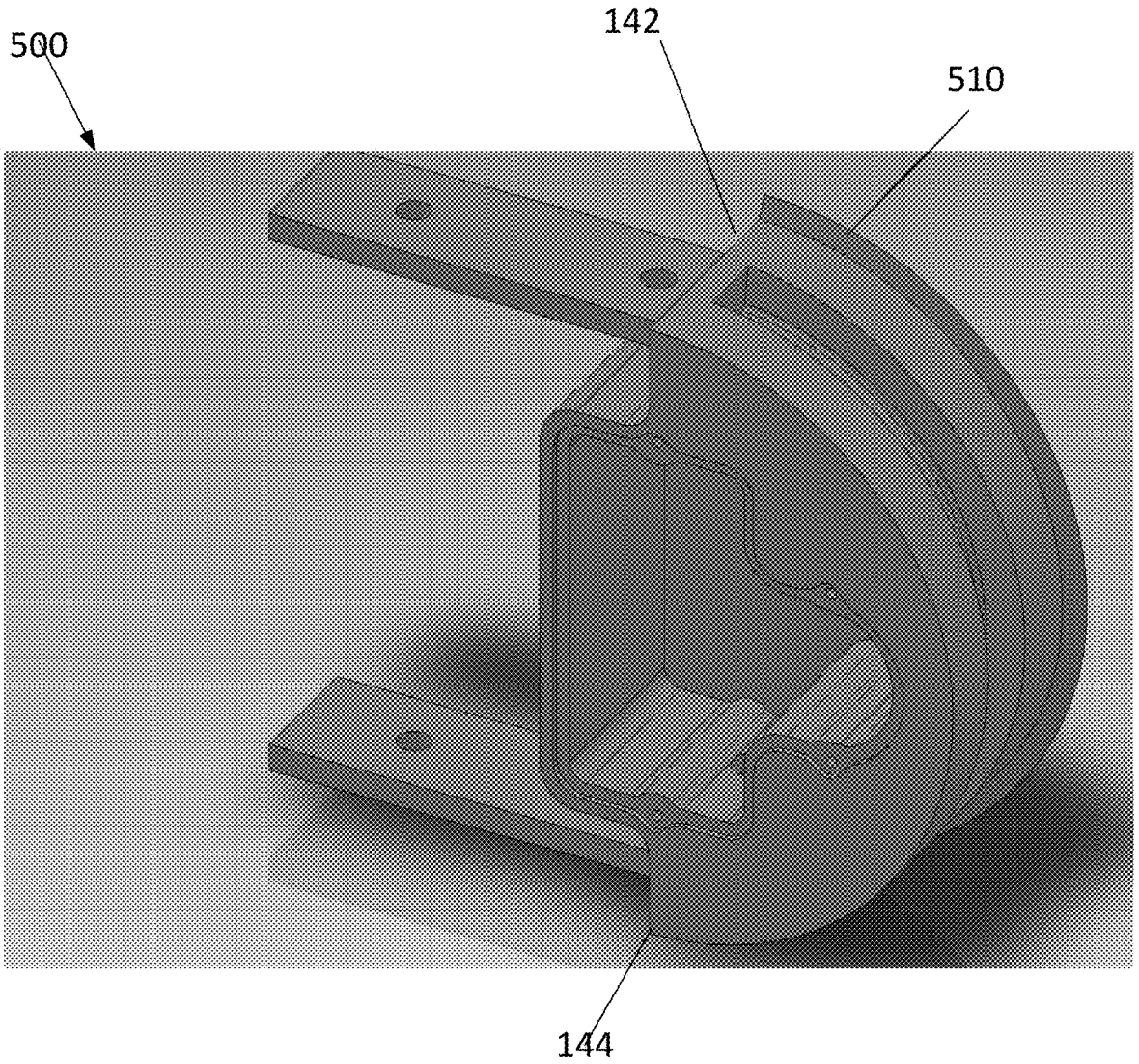
FIG. 5 depicts a lighting device, according to an embodiment.

FIG. 5 depicts one embodiment of a lighting device 500. Elements represented in lighting device 500 may be substantially the same as other previously described embodiments. Therefore, for the sake of brevity an additional description of these elements is omitted.

As depicted in FIG. 5, lighting device 500 may include a cutting or breaking blade 510, wherein cutting blade 510 may be positioned on a first side of lighting device 500, wherein cutting blade is an extension of the sidewall of lighting device 500. Cutting blade 510 may be positioned on a first side of lighting device 500 so that light from the light emitters is not obstructed by cutting blade 510. However, in other embodiments, cutting blades 510 may be positioned on both sides of lighting device 500.

Cutting blade 510 may be a metal blade or comprised of other rigid materials, which projects away from the external circumference of lighting device 500. Cutting blade 510 may extend from first end 142 of lighting device 500 to second end 144 of lighting device 500. Cutting blade 510 may extend across the entire circumference of lighting device 500 so it does not matter which end of lighting device is positioned forward when breaking a window. Accordingly, both sides of cutting blade 510 may be utilized to break a window. In embodiments, because cutting blade 510 may extend from first end 142 to second end 144 of lighting device 500, cutting blade 510 may have a longer length than channel 140.

In embodiments, responsive to positioning a top end of a ladder proximate to a window, cutting blade 510 may be positioned adjacent to the window. When cutting blade 510 contacts the window, cutting blade 510 may apply sufficient force against the window to break the window. Therefore, by utilizing a lighting device 500 within an integrated cutting blade 510 that extends across the circumference of lighting device 500, firefighters may reduce the amount of time necessary to break and enter or exit out of a window.

Figure 6:
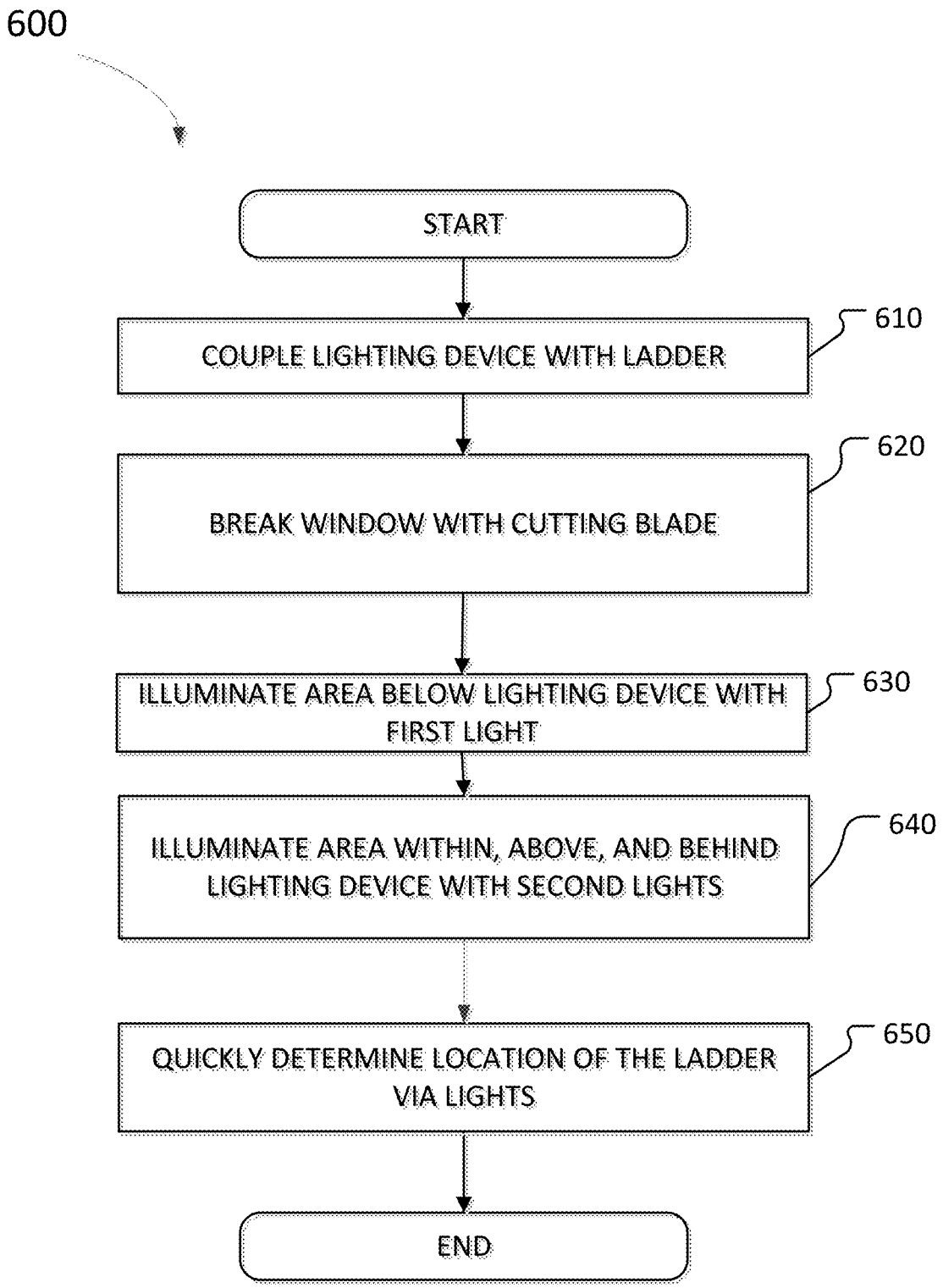
FIG. 6 depicts a method for utilizing a lighting device, according to an embodiment.

FIG. 6 depicts a method 600 for utilizing a lighting device. The operations of method 600 presented below are intended to be illustrative. In some embodiments, method 600 may be accomplished with one or more additional operations not described, and/or without one or more of the operations discussed. Additionally, the order in which the operations of method 600 are illustrated in FIG. 6 and described below is not intended to be limiting.

At operation 610, a lighting device may be coupled to the end of a rail of a ladder. The lighting device may be coupled to the rail by aligning projections extending away from the body of the lighting device with slots within the rail. Responsive to inserting the projections into the slots, the lighting device may be coupled to the rail, wherein the sides of the lighting device may be flush with the sides of the rail.

At operation 620, a ladder may be positioned proximate to a window, and a cutting blade on the lighting device may be positioned adjacent to the window. Responsive to the cutting blade being positioned adjacent to the window, the cutting blade may break or shatter the window. When the cutting blade shatters the window, the lighting device may be positioned within the building, window, wall, entry point, etc. on the opposite side of the building as the base of the ladder.

At operation 630, a first light positioned on proximate to a first end of the lighting device may emit light on a floor surface directly below the lighting device. The first light may be configured to emit visible light, wherein when a firefighter is within a building, the firefighter may be able to quickly determine the location of the ladder or obstructions in a departure area proximate to the ladder.

At operation 640, second lights positioned from the first light to the second end of the lighting device may emit light within the building, above the building, and behind the ladder. The second lights may be positioned at even intervals from the first light to the second end, wherein the second lights may be configured to blink and/or emit light at repetitive intervals. In embodiments, the second lights may emit a different type of light than the first type of light, which may be utilized to communicate a numbered unit.

At operation 650, utilizing the first light and the second lights positioned within the building a firefighter may be able to quickly determine the location of the ladder within the room, while also having the room illuminated. Therefore, a firefighter may be able to quickly enter and/or exit the building. In other words, individuals within a structure may be able to see the lights emitted by the ladder, and exit the building.

Although the present technology has been described in detail for the purpose of illustration based on what is currently considered to be the most practical and preferred implementations, it is to be understood that such detail is solely for that purpose and that the technology is not limited to the disclosed implementations, but, on the contrary, is intended to cover modifications and equivalent arrangements that are within the spirit and scope of the appended claims. For example, it is to be understood that the present technology contemplates that, to the extent possible, one or more features of any implementation can be combined with one or more features of any other implementation.

Reference throughout this specification to "one embodiment", "an embodiment", "one example" or "an example" means that a particular feature, structure or characteristic described in connection with the embodiment or example is included in at least one embodiment of the present invention. Thus, appearances of the phrases "in one embodiment", "in an embodiment", "one example" or "an example" in various places throughout this specification are not necessarily all referring to the same embodiment or example. Furthermore, the particular features, structures or characteristics may be combined in any suitable combinations and/or sub-combinations in one or more embodiments or examples. In addition, it is appreciated that the figures provided herewith are for explanation purposes to persons ordinarily skilled in the art and that the drawings are not necessarily drawn to scale.

What is claimed is:

1. A light emitting device the device comprising:

a body with a lower surface and an overhang, wherein a portion of the body includes a curved outer surface, the lower surface being positioned below the overhang;

a channel positioned within the curved outer surface, the channel extending across an apex of the curved outer surface;

at least one light positioned within the channel;

a projection having an upper surface positioned on the overhang and a bottom surface extending past the lower surface of the body.

2. The device of claim 1, wherein the channel includes a first channel sidewall, a second channel sidewall, and a lower channel surface, the lower channel surface extending from the first channel sidewall to the second channel sidewall.

3. The device of claim 2, wherein a first curvature of the lower channel surface corresponds with a second curvature of the curved outer surface.

4. The device of claim 1, wherein the curved outer surface includes a first end and a second end, and the channel includes a third end and a fourth end, a length from the first end to the third end is equal to the length from the second end to the fourth end.

5. The device of claim 4, wherein the third end of the channel is positioned between an outer boundary of the lower surface and the first end of the body.

6. The device of claim 1, wherein a width of the channel is less than a width of the projection.

7. The device of claim 1, wherein the at least one light are positioned at even intervals along the channel.

8. The device of claim 1, wherein the channel is positioned along a central axis of the curved outer surface.

9. The device of claim 1, wherein the at least one light includes a first type of light and a second type of light positioned in the channel.

10. The device of claim 1, wherein the channel does not extend along the entirety of the curved outer surface.

11. The device of claim 1, wherein the channel is embedded within the curved outer surface.

* * * * *